US005501846A

United States Patent [19]

Pavelle et al.

[11] Patent Number: 5,501,846

[45] Date of Patent: Mar. 26, 1996

[54] APPARATUS FOR INCREASING CATALYTIC EFFICIENCY

[76] Inventors: Richard Pavelle, 23 Berkshire Dr.; Paul Burstein, 19 Glengarry, both of Winchester, Mass. 01890; Leon Ferber, 2310 Stearns Hill Rd., Waltham, Mass. 02154; Ronald M. Latanision, 28 Nassau Dr., Winchester, Mass. 01890

[21] Appl. No.: 287,344

[22] Filed: Aug. 8, 1994

Related U.S. Application Data

[63] Continuation of Ser. No. 37,478, Mar. 26, 1993, abandoned, which is a continuation of Ser. No. 598,477, Oct. 16, 1990, abandoned, which is a continuation-in-part of Ser. No. 369,370, Jun. 21, 1989, Pat. No. 4,968,395.

[51] Int. Cl.[6] ..... F01N 3/10

[52] U.S. Cl. ..... 422/211; 422/217; 422/221; 422/222; 422/180; 60/299

[58] Field of Search ..... 422/142, 143, 422/144, 174–180, 211, 217, 221, 222; 60/302, 299; 204/130; 123/23

[56] References Cited

U.S. PATENT DOCUMENTS

| | | | |
|---|---|---|---|
| 3,915,890 | 10/1975 | Soldate | 422/144 |
| 4,396,480 | 8/1983 | Hegedus et al. | 429/33 |
| 4,876,072 | 10/1989 | Checki | 60/302 |
| 4,968,395 | 11/1990 | Pavelle et al. | 204/130 |
| 5,245,093 | 9/1993 | Ember | 585/266 |

*Primary Examiner*—Jill Warden
*Assistant Examiner*—Long V. Le
*Attorney, Agent, or Firm*—Sprung Horn Kramer & Woods

[57] ABSTRACT

A catalytic process and apparatus which is mechanically manipulated to increase the operating efficiency thereof. Provision is made for the application of an electric current during mechanical manipulation of the catalyst such as may be useful in certain instances.

15 Claims, 4 Drawing Sheets

APPARATUS FOR INCREASING CATALYTIC EFFICIENCY

This application is a continuation of application Ser. No. 08/037,478, filed Mar. 26, 1993, now abandoned, which is a continuation of application Ser. No. 07,598,477, filed Oct. 16, 1990, now abandoned, which is a continuation in-part application of U.S. patent application Ser. No. 369,370 filed Jun. 21, 1989 and now U.S. Pat. No. 4,968,395.

BACKGROUND OF THE INVENTION

The present invention relates to the use of catalysts in chemical reactions. The main function of a catalyst is to provide a changed local structure that yields a site for a reaction to occur without the catalyst being used up itself. Catalysis gained prominence shortly after WW II as "catalytic reforming" revolutionized the petroleum industry. The literature abounds with references to catalysis applied to numerous processes.

Many chemical reactions (inorganic and organic) are catalytically sensitive. Platinum and palladium are the two most common catalytic materials. These are used for a wide variety of organic oxidation reactions. Nickel is a familiar hydrogenation catalyst. Ammonia synthesis is catalytic. It is to this type of process that the present invention is directed. Any chemical reaction is catalytically sensitive. Some are more so than others. It is well known that the total surface area and/or volume, occlusive capacity, and the local physical properties of the catalyst in such a process partially determine the reaction rates. These factors can be affected drastically by the detailed preparation and maintenance of the catalyst and the environment in which it functions. For example, impurities that find their way into the catalyst during processing may markedly effect its performance. Similarly, catalytic poisons present in the reactants may diminish the behavior of the catalyst. After some time in regular use, contaminants may render the catalyst less efficient than it would otherwise be.

SUMMARY OF THE INVENTION

Those knowledgeable in the field have not attempted to mechanically manipulate the catalysts in order to control their efficiency. It is the main object of the present invention to provide methods, and apparatus for accomplishing this function, thereby increasing the overall efficiency of these processes with a minimum of manual replacement, overhaul or other method that requires removal (e.g., for cleaning) of the catalyst from its functional environment.

The purpose of mechanical manipulation is to extend or enhance the initial efficiency provided by the catalyst in order to nullify the degrading effects of the process or the catalyst's preparation. This manipulation also affects confinement times and the mobility of the reactants in the lattice and at its surface. For example, it is known that the catalyst's surface character changes with time, depending upon the process.

The methods and apparatus described herein are primarily mechanical and electromagnetic in nature. The aim of these methods is the break-up of large crystallites of the catalytic lattice into much smaller (perhaps, atomic-scale) domains. This will enhance the catalytic process.

The mechanical methods include compression, tension and torque, shock, and acoustic wave generation. These can be applied in either static or dynamic (time-varying) mode, as discussed hereinafter. Other methods such as electromagnetic pulses (e.g., plasma arc) and laser activation at the surface of the catalyst are also within the scope of the invention.

These and other features and advantages of the present invention will be described in more detail hereinafter with respect to the attached drawings wherein:

DETAILED DESCRIPTION OF THE INVENTION

FIGS. 1–5 show different embodiments of catalysts according to the invention.

Figure 1:
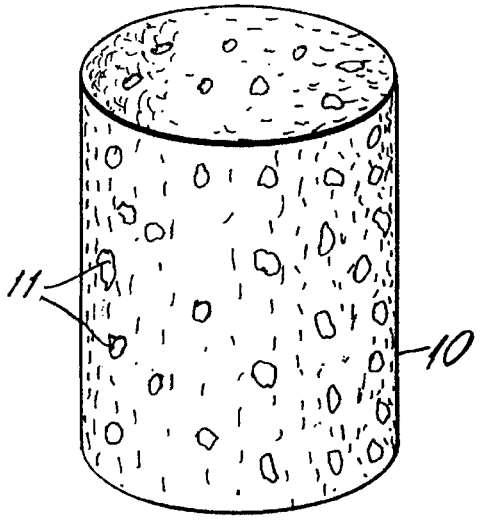
FIGS. 1–5 illustrate different configurations of catalysts in accordance with the invention.
Figure 2:
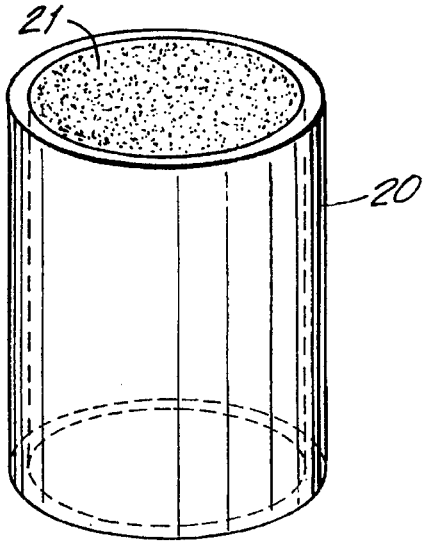

Very often, a catalyst must be run in high temperature environments, for example catalytic converters for automobile and power plant emissions. One method for protecting the catalyst 11 is by its suspension in a ceramic, alloy or carbon-carbon host 10 as shown in FIG. 1, or any similar material with special properties; these properties include good immunity to high temperature and porosity, thus still allowing the flow of reactants to the catalyst. This rigid bonding as shown in FIG. 1 can also maintain the catalyst's molecular/particulate orientation and the local physical properties that might otherwise be disturbed by the chemical process or by the local environment (e.g., temperature, pressure).

A second implementation (FIG. 2) involves packing a catalyst 21 in powdered state into a hollow form, e.g., a cylinder 20 or the like, the object being that the reactant flow through the interstitial spaces in the cylinder and into the powder. This clearly provides a porous access to the catalyst, thus still allowing the flow of reactants. This configuration maximizes the surface area presented by the catalyst, but does not provide the same tight molecular binding/orientation as provided by the previous embodiment. The use of a conductive dopant may be necessary in this configuration, if the catalyst itself (e.g., titanium) is not a good electrical conductor. The actual chemical doping of the catalytic electrode can be accomplished during its manufacture, prior to its integration into the catalysis cell. The above provision is made to allow application of an electric current during mechanical manipulation of the catalyst such as may be useful in certain instances.

To this point the discussion has assumed a traditional view of catalysis as being a surface phenomenon, i.e., as occurring at an interface. These embodiments also apply where the catalysis occurs within a volume, e.g., the absorption of a gas or plasma by a lattice structure. In this case, diffusion of the reactants into the catalyst must proceed at a minimum rate for a threshold yield. Physical alignments (of a crystal structure, for example) or the application of pressure or voltage can be critical, because distortion of the catalyst structure may enhance the reaction rate enormously. A lattice can be disrupted by application of such a perturbation to cause a rupture in the otherwise regular crystal structure of the catalyst. This type of distortion can propagate throughout the volume and enhance the diffusion and reaction rates of the process. The introduction of these forces leads to this type of desirable domain-cracking.

Whereas the previous embodiments were well-suited for high temperature environments and for either volume or surface-dominated processes, the present embodiment is designed for use in surface-dominated processes where there are either high or low temperature components. The dominant concept is the maximization of the reactive surface area, perhaps in association with minimized volume.

There are two classes of configurations, one based on foils, the second based on assemblies of thin tubes or cylinders or the like.

The advantage of the foil based configurations is that they are easily formed from available stock through elementary metal-forming processes. For example, rolls of titanium stock, 0.001–0.010 inch thick, can be readily formed into a cylindrical spiral 30 (see FIG. 3). The tightness of the spiral determines the amount of surface area available to the reactants. Similarly, the wave-like configuration 40 of FIG. 4 will also yield high surface area in a minimum volume. This configuration is also easily formed with conventional materials and standard metallurgical techniques.

Figure 5:
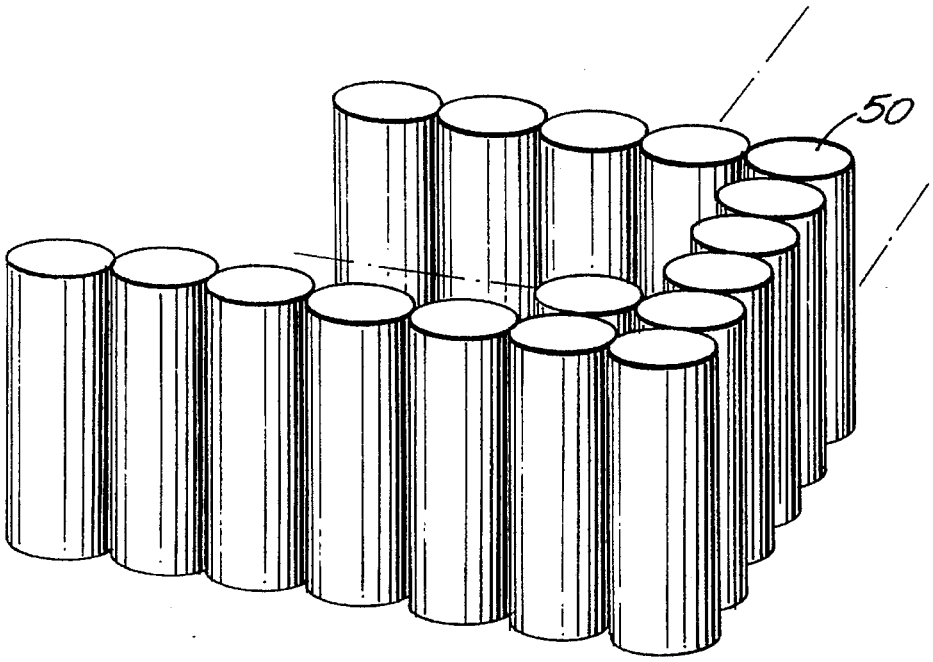

The second class of configurations is based on a modular array of tubular building blocks 50, whose surfaces may be rectangular or round or any convenient cross-section as shown FIG. 5. These structures may be solid or hollow which allows heat to be extracted or dissipated by passing a fluid through the center.

Figure 3:
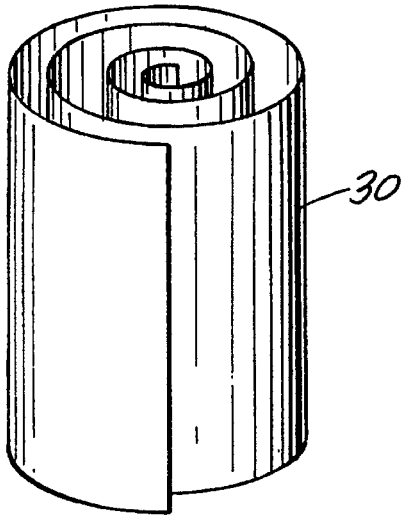
Figure 4:
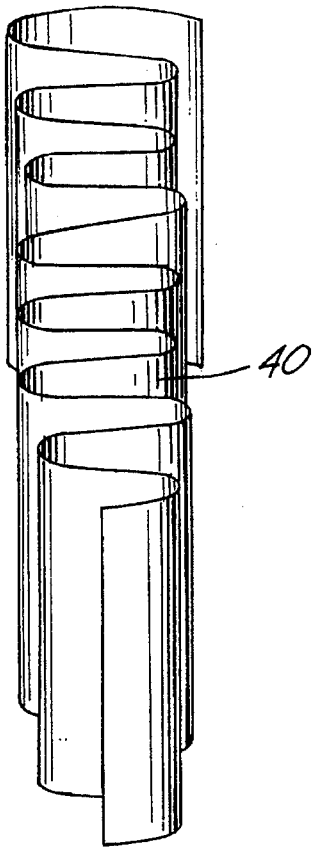

The structures of FIGS. 3 and 4 can also be used as modules in superstructures that follow the pattern of FIG. 5.

Compression can be delivered to the catalyst via direct mechanical means or by coupling through a medium. The purpose of the compression is to exert a non-uniform stress on the micro-structure of the catalyst thereby either breaking local bonds that inhibit the desired reaction, or to produce a local strain in the lattice that may favor a precess which is otherwise sub-critical. A preferred means of compression is via application of hydraulic pressure directly on the catalyst. This method allows precise force to be applied to the catalyst. Either of two configurations will suffice: (1) The catalyst protrudes from the reactant solution and the compressive force is applied outside the solution; (2) The compression element is immersed in the reactant solution, and the compressive force is applied within the solution.

This method favors structures that can support the compression without significant mechanical deformation, e.g., the tube structure of FIG. 5 or the ceramic host of FIG. 1. Clearly, the latter can absorb far more compression without macroscopic deformation than the former. If properly designed, even the tube structures can be built to withstand pressures in excess of 100 atmospheres, as seen in honeycomb structures commonly used in aircraft components.

Figure 6:
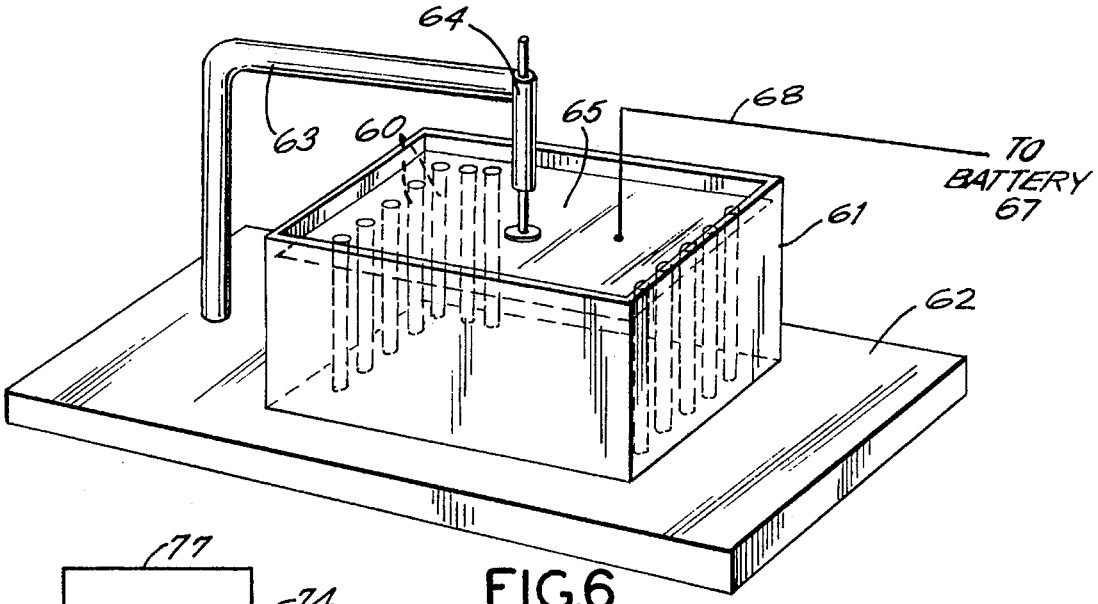
FIGS. 6–10 illustrate alternative embodiments for manipulating catalysts in accordance with the invention.

FIG. 6 shows a complete configuration utilizing hydraulic pressure to compress an array of catalyst tubes shown seen in FIG. 5. A containment vessel 61 is positioned on a rigid base 62, with a rigid arm 63 which supports a hydraulic piston 64. The piston is attached to the conductive plate 65, through which pressure is applied to a catalyst array 60. A conductor 68 is affixed to the plate 65 providing means of attachment to a power source 67, which may be useful in some instances.

Figure 7:
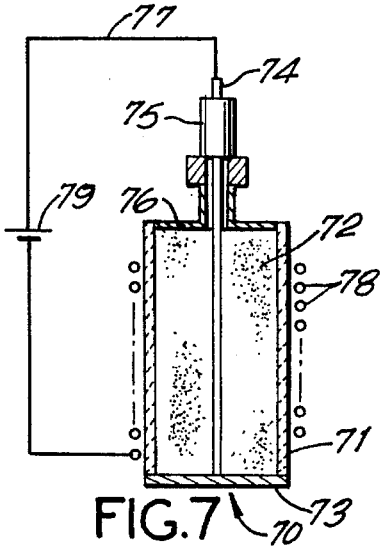

Another example is the powdered configuration in a hollow form, where a ram acting as a control rod can be used to apply pressure to the catalyst directly, thereby controlling the reaction rate. Far greater pressure can be applied in this case, perhaps as much as 1000 atmospheres for large-scale structures. FIG. 7 presents a simplified cut-away view of such a configuration. The catalytic assembly 70, consisting of a ceramic cylinder 71, is filled with powdered catalytic material 72. A baseplate 73 is attached to a rod 74 which penetrates through the powdered material. The purpose of the rod is to provide a tension-affixment point for traveling plate 76 and held in position by hydraulic piston 75 at a predetermined pressure. The rod 74 is optionally connected to a conductor 77 power supply 79 and second electrode 78, which may be useful in some instances.

The pressures of $10^6$ atmospheres and greater that are used for specialized processes, e.g., artificial diamonds, are not appropriate here because the region over which these high pressures can be applied must be small; the size of these regions is limited by the intrinsic material deformation properties.

Figure 8:
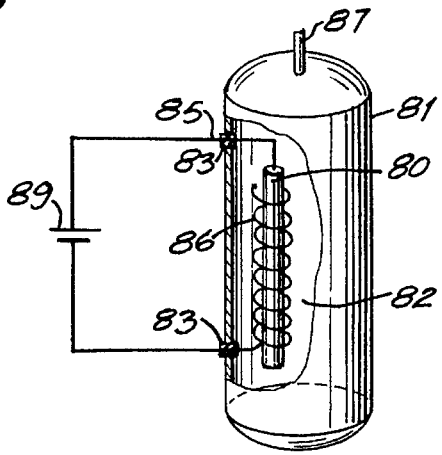

The reactant environment itself can be pressurized externally and the hydrostatic pressure employed to serve the compression function. This method can be used to a pressure of 100 atmospheres without serious difficulty. This is a particularly effective embodiment, since the reactant environment serves two purposes simultaneously, as shown in FIG. 8. The vessel in the form of a cylinder 81 containing a working environment 82 is pressurized through inlet valve 87. A catalyst 80 is suspended in the environment by means of conductor 85, which is surrounded by (but not touching) an electrode 86. The conductors are inserted through the wall of the pressure vessel via pressure seals 83 and connected to opposite poles of a battery or other power source 87. As in previous embodiments, electrical contacts (85 and 86) may or may not be used in the operation of the catalyst for a variety of purposes.

Tension can be applied by fixing the ends of the catalytic electrode to plates or the like which can then be pulled apart and/or twisted with specified force or frequency. Tension and torque can be applied to specimen configurations that include both foils and assemblies of thin tubes or cylinders as discussed previously, as well as to other common catalyst configurations. For thin tubes, deformations of several minutes of arc (angular measure) in displacement of top and bottom could be carried out, deformations of 1 degree, even for the longest of tubes, appear to be the outer limit for this technique.

Figure 9:
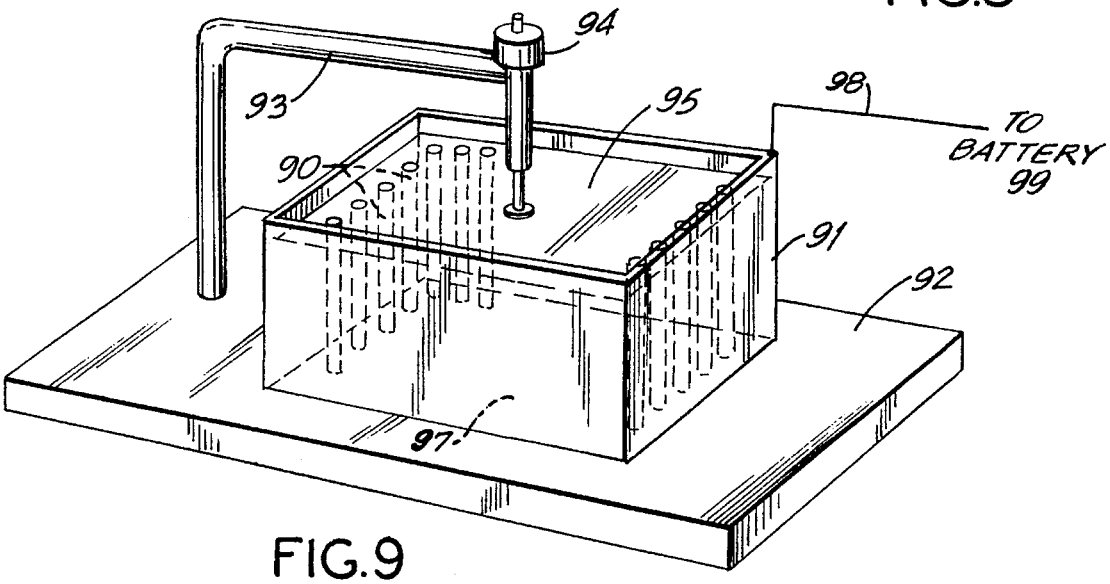

FIG. 9 shows a complete configuration utilizing hydraulic pressure to pull an array of catalyst tubes 90 as originally seen in FIG. 5. The tubes are rigidly fastened to top and bottom plates 95 and 97. A containment vessel 91 is positioned on a rigid base 92, with a rigid arm 93 which supports a hydraulic piston 94 whose force direction is up, away from the vessel. The piston is attached to but electrically insulated from the top plate 95, through which tension is applied to the catalyst array 90. A conductor 98 is affixed to the plate 95 providing means of attachment to a power source 99.

Figure 10:
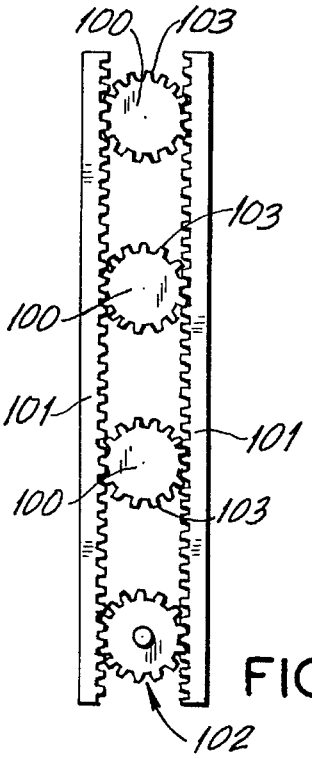

FIG. 10 shows a configuration for twisting the array of catalyst tubes. The distinguishing characteristic for applying such a torque is that it must be applied to each element individually. Thus, the arrangement of FIG. 10 shows a top view of three elements 100 of an array, each of which is configured with an insulating pinion gear 103 rigidly affixed to the top of the tube. Rack gears 101 engage the pinion gears so that any translation of the rack provided by gear 102 which is driven by a motor (not shown) results in a specified angular displacement of all the tops of the tubes. The racks work in equal and opposite directions. Moreover they can be double-sided, thus providing motion to another set of pinions located on the opposite side of the first set. In this way a two-dimensional array of such tubes can be driven at specified twist angle.

The purpose of a shock wave in the catalyst is to disturb any higher order alignments which may interfere with the catalytic process. Thus, the shorter the time scale over which the shock is delivered, the larger the instantaneous force imparted to the structure of the catalyst.

Figure 11:
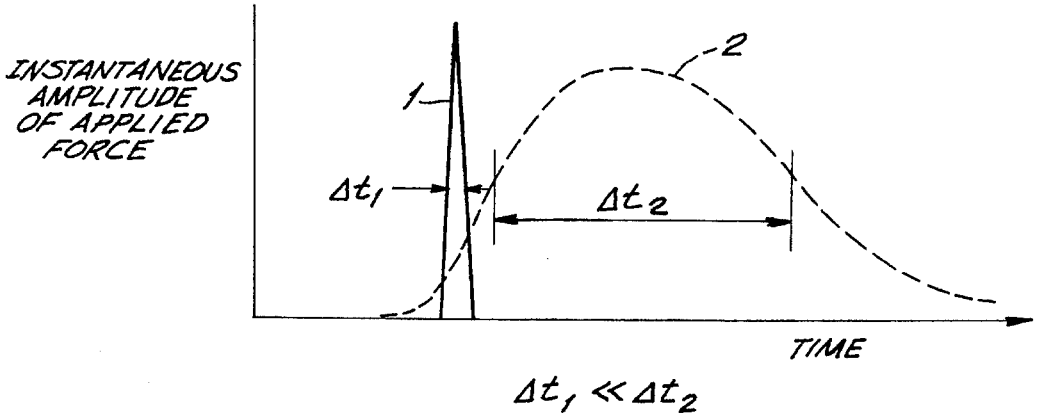
FIG. 11 is a graph showing effect of force on a catalyst.

The purpose of the shock (or any of the other time-varying techniques of dynamic manipulation) is to induce a wave or series of waves of adjustable amplitudes and frequencies that will break the large-scale domains into smaller scale regions. Thus, physical devices that can deliver sharp impulse functions as shown in FIG. 11 are to be preferred to those that operate in more limited frequency ranges. In most materials, the velocities (both shear and longitudinal) vary between $10^5$–$10^6$ cm/sec. The approach utilizes the differential velocity between and instantaneous amplitudes of the different frequency components so that opposite forces can be generated within small spatial scales. This small and local destructive interference within the catalyst can be tailored to the desired spatial scale. It is noted that single frequencies are impractical for achieving disruptions on this spatial scale, since frequencies on the order of $10^{10}$ or $10^{11}$ cycles per second would be required. Thus, for spatial scales measured in angstroms or hundreds of angstroms and the aforementioned velocities, the preferred frequency is on the order of 50,000 Hz for a catalyst of characteristic length 10 cm; at the same time, a nominal bandwidth of sufficient width must be maintained about that central frequency so that the inter-frequency force differences result in local lattice deformation. The frequency scales inversely with the catalyst size. Thus, a 100 cm long catalyst would require a 5000 Hz minimum frequency. Much smaller frequencies result in uniform displacements of the catalyst, and so there is no differential force.

To the extent that periodicities in the applied signal and reflections from the boundaries of the catalyst and their holding fixtures exist, resonances can be made to occur. These resonances result in tremendous local forces and displacements which may or may not be beneficial to the particular process. By varying the applied frequency spectrum and the duty cycle, the position and magnitude of this resonance can be changed. Thus, the resonance could be made to follow a pre-determined periodic path through the catalyst.

Figure 12:
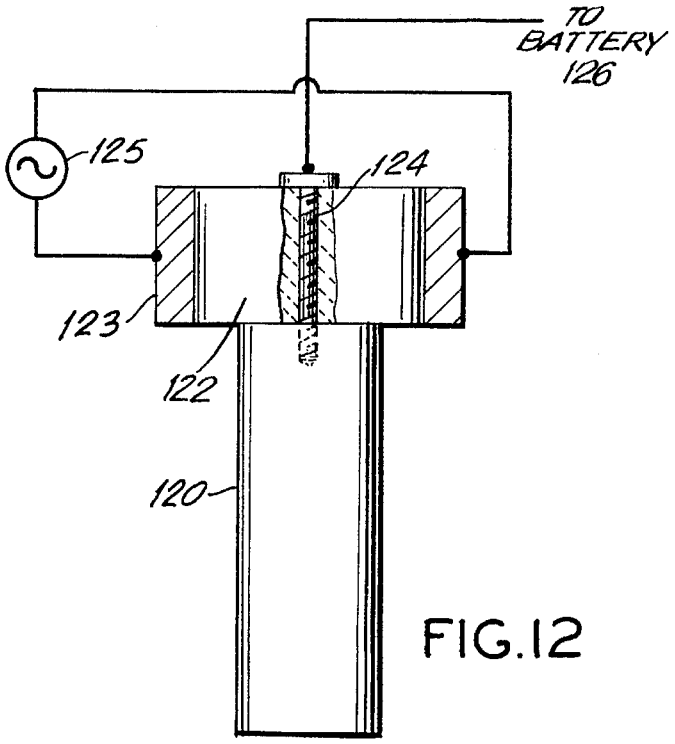
FIGS. 12–13 illustrate further embodiments for manipulating catalysts in accordance with the invention.

A mechanical impulse may be imparted by a device as simple as a pneumatic tool such as an air hammer, or as sophisticated as an external piezoelectric crystal electrically insulated from the catalyst. Frequencies for the pneumatic approach might be as high as $10^4$ cycles per second, while the piezoelectric approach offers the possibility of megahertz excitations. FIG. 12 shows a simplified view of a catalyst 120 as being driven by a piezoelectric transducer. The transducer consists of a ceramic body 122 and two conducting plates 123. The conducting plates are connected to a signal generator 125 and to the catalyst by means of a screw 124. While this screw is shown as being the conductor leading to the battery 126, this connection is not necessary.

Shock can also be imparted via acoustic devices, but the coupling medium often required by such acoustic sources lengthens the time-scale over which the shock is applied. This increase in time results in a much smaller instantaneous magnitude for the applied force.

Acoustic methods generate waves in the catalyst to break up the higher order alignments that may result in supercrystallite structures that reduce the efficiency of the catalytic process. What normally distinguishes acoustic methods from other more direct mechanical methods is the need for a medium to couple the transducer to the specimen. In particular, acoustic transducers may be attached to any of the heretofore mentioned embodiments both internal and external to the solution to effect this transfer of acoustic energy into the structure of the catalyst.

Acoustic transducers are especially amenable to variable amplitude, frequency, and pulse shaping. Thus, the acoustic pulses can be tailored to the specific shape and configuration of the catalyst. This approach can be used to exploit natural resonances of the electrode or its microstructures.

Figure 13:
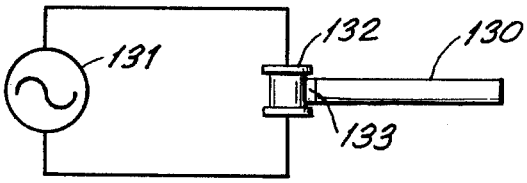

FIG. 13 shows an ultrasonic transducer 132 which is coupled to the catalyst 130 be means of the coupling medium 133, typically a commercial gel made expressly for this purpose. The transducer is of a type similar to, for example, Picker type 595516D which can operate at frequencies as high as 2 MHz. The transducer is driven by a commercial signal generator 131, e.g., Wavetek or Hewlett Packard, whose output is typically routed to the transducer by means of a coaxial UHF cable.

Dislocations in local structure can be brought about by the application of intense radiation. This can be in the form of bombardment by x- and gamma rays, neutrons, or, in the case of a very thin catalyst, electrons. The advantage for this type of approach is the continuous non-contact nature of the radiation. No local mechanical stress need be applied. Thus, the radiation method can be utilized with very thin-walled or otherwise physically delicate catalysts. A typical configuration would involve placing such a reaction chamber near a gamma ray producer. Large installations could employ an on-site reactor to produce high doses of these radiations. Typical dose rates of 1 megarad–100 megarads can disrupt the local crystal structure, and lead to embrittlement and fatigue-like symptoms of the catalyst.

Another form of catalyst "manipulation" by energy application that can bring about such defects is microwaves. The mechanism is local heating by excitation of internal vibrational and rotational modes of molecules or large scale (compared to molecular sizes) crystal structures. Thus, stress concentration caused by uneven absorption of the radiation can cause the catalyst to fracture internally, thus exposing more catalyst surface. The attractiveness of using microwaves for such improvements in catalytic efficiency lies in the ability of the operator to control the efficiency from a distance. This action-at-a-distance approach allows the ability to control the reaction rate of various processes from outside the region of reaction. Thus, formerly inaccessible reactions, e.g., caustic flows over internal catalyst surfaces, can now be controlled through such a process. Moreover, the catalyst material and supporting structure could be constructed to take advantage of such energy absorption. This construction could be either in micromechanical form (e.g., a structure similar to a metal matrix material) or a macromechanical form (e.g., large structure that expands under heat at a rate different from that of a thin layer of catalyst, thus utilizing the different coefficients of thermal expansion). Designer catalysts with properties tailored to preferential absorption and stress creation (or reduction) could be manufactured to control the rate of catalysis from a remote application site. Microwaves provide only one example of such application. Other radiations, both electromagnetic and mechanical (e.g., laser light and ultrasound, respectively), present similar possibilities.

Any of these methods can be applied simultaneously or in series with any of the other methods. Moreover, the frequency of application can also be varied at will. This multi-dimensional approach obviates the difficulties posed by the limits of any single method. For example, the combination of tension and torque may be made cyclic on timescales ranging from milliseconds to minutes. Piezoelectric approaches can be varied on timescales of microseconds.

Certain chemical processes may be inhibited by the formation of undesired products of reaction (e.g., films or poisons) on the catalyst surface. The build-up of reaction product films or other contaminants on the catalyst could be avoided by these methods. Deformation will cause break-up of such films while exposing fresh catalyst surfaces to the reaction environment.

It will be appreciated that the instant specification and claims are set forth by way of illustration and not limitation, and that various modifications and changes may be made without departing from the spirit and scope of the present invention.

What is claimed is:

1. An apparatus for a non-electrolytic catalytic process, comprising: at least one catalyst configured as of formed and shaped solid disconnected from a source of electrical energy and means for mechanically manipulating and deforming the at least one catalyst to control its operating efficiency.

2. The apparatus according to claim 1, wherein the means for manipulating comprises means for applying a force.

3. The apparatus according to claim 2, wherein the means for applying a force comprises means for applying a static force.

4. The apparatus according to claim 2, wherein the means for applying a force comprises means for applying a dynamic time-varying force.

5. The apparatus according to claim 2, wherein the means for applying a force comprises means for compressing the catalyst.

6. The apparatus according to claim 2, wherein the means for applying a force comprises means for torquing the catalyst.

7. The apparatus according to claim 2, wherein the means for applying a force comprises means for applying tension to the catalyst.

8. The apparatus according to claim 2, wherein the means for applying a force comprises means for applying an acoustic wave to the catalyst.

9. The apparatus according to claim 2, wherein the means for applying a force comprises means for applying a shock to the catalyst.

10. The apparatus according to claim 1, wherein the at least one catalyst comprises a wound sheet.

11. The apparatus according to claim 1, wherein the at least one catalyst comprises a corrugated sheet.

12. The apparatus according to claim 1, wherein the at least one catalyst comprises a plurality of parallel tubular members.

13. The apparatus according to claim 1, wherein the at least one catalyst comprises a ceramic member with catalyst particles embedded therein.

14. The apparatus according to claim 1, wherein the at least one catalyst absorbs radiation and the means for manipulating comprises means for applying radiation to the at least one catalyst.

15. The apparatus according to claim 1, wherein the catalyst is configured as a foil or a tube.

* * * * *